United States Patent [19]

Mueller et al.

[11] 4,365,904

[45] Dec. 28, 1982

[54] LINESPACING APPARATUS

[75] Inventors: Hans W. Mueller; Richard E. Shattuck; Albert H. Cryder, all of Cortland; John L. Nelson, Ithaca, all of N.Y.

[73] Assignee: SCM Corporation, New York, N.Y.

[21] Appl. No.: 254,034

[22] Filed: Apr. 14, 1981

[51] Int. Cl.[3] ..... B41J 19/92

[52] U.S. Cl. ..... 400/568; 400/569; 400/575.2; 400/577

[58] Field of Search ..... 400/568, 569, 570, 571, 400/575.1, 575.2, 577

[56] References Cited

U.S. PATENT DOCUMENTS

| | | | |
|---|---|---|---|
| 2,192,351 | 3/1940 | Kleinschmidt | 400/570 X |
| 3,433,345 | 3/1969 | Gaissert et al. | 400/575.1 X |
| 3,668,942 | 6/1972 | Landis et al. | 400/568 X |
| 3,978,963 | 9/1976 | Baffo | 400/568 X |

*Primary Examiner*—Paul T. Sewell
*Assistant Examiner*—Daniel J. Roock
*Attorney, Agent, or Firm*—Kenneth W. Greb; Ernest F. Weinberger

[57] ABSTRACT

A linespacing apparatus includes a slip clutch assembly which is driven by an electric motor. The slip clutch assembly includes a face cam which drives a linkage which, in turn, indexes a platen in order to linespace the platen. The face cam includes an abutment portion which abruptly halts the motion of the linkage and the slip clutch assembly prevents bounce or recoil of the linkage thereby promoting smooth operation of the apparatus. The linkage may be adjusted by an operator to vary the amount of rotation of the platen during each operating stroke of the linkage.

6 Claims, 4 Drawing Figures

LINESPACING APPARATUS

BACKGROUND OF THE INVENTION

The prior art related to printing and typewriting equipment includes various examples of linespacing mechanisms including: U.S. Pat. No. 1,469,776 to M. C. Crawley, U.S. Pat. No. 1,861,975 to R. E. Page and U.S. Pat. No. 2,777,559 to L. E. Tapp. U.S. Pat. No. 1,469,776 shows a linespace mechanism which has a friction clutch located between a motor and a linespace linkage. U.S. Pat. No. 1,861,975 shows a linespace mechanism which has a first cam with a continuous cam track for driving a linespace linkage. The linespace mechanism also includes a second cam and the linespace linkage may be driven by either cam. The cams are operated alternatively depending on the amount of linespacing desired. U.S. Pat. No. 2,777,559 shows a linespace mechanism which has a cam for driving a linespace linkage. The cam has a follower whose position relative to the axis of the cam may be varied in order to vary the amount that the roller is displaced during each turn of the cam.

Each of the above devices may be characterized as having a relatively high degree of complexity and comprising a relatively large number of component parts. This results in an overall high cost of ownership due to the relatively high initial costs which result from a need for careful, close tolerance, manufacturing techniques and complex assembly procedures and the relatively high maintenance costs which result from a need for frequent maintenance and adjustment procedures.

OBJECTS OF THE INVENTION

It is an object of the invention to overcome the disadvantages of the prior art by providing a linespace apparatus for printing equipment which can be operated by an electrical signal to quickly and efficiently linespace a platen.

Another object of the invention is to provide a linespacing apparatus which is operated by a D.C. motor and which incorporates a friction clutch assembly to provide smooth operation with minimal stress on the component parts.

Another object of the present invention is to provide a linespace apparatus which incorporates a cam member.

Another object of the present invention is to provide a linespace apparatus which may be easily operated to vary the number of lines spaced on a platen.

Another object of the present invention is to provide a linespace apparatus which incorporates an abutment for limiting the amount of drive of a linespacing linkage.

Still another object of the present invention is to provide a linespacing apparatus which is composed of a relatively small number of simple parts which can be easily manufactured in large volume resulting in a relatively low unit cost.

SUMMARY OF THE INVENTION

In accordance with the present invention there is provided a linespacing apparatus which is driven by an electric motor which is controlled by depressing selected keys on a typewriter keyboard. The electric motor is connected through a gear chain to a friction clutch on which there is mounted a face cam. A follower roller, which is mounted on an arm of a linespacing linkage, rides within a groove formed in the face cam. Rotation of the electric motor drives the linespacing linkage to engage a pawl on an arm of the linespacing linkage with a ratchet wheel mounted on a platen and thereby indexing the platen and accomplishing the linespacing function. The groove in the face cam includes an abutment wall which engages the follower roller and abruptly limits the drive of the linespacing mechanism thereby controlling the amount of rotation of the platen to the number of linespace desired. The friction clutch absorbs the impact of the abrupt halting of the linespacing mechanism and the rotational inertia of the electrical motor which continues to coast to a halt. The friction clutch thus prevents bounce and recoil of the linespacing mechanism and ensures smooth operation of the linespacing apparatus.

The amount of rotation of the platen is controlled by a linkage which may be adjusted by an operator to vary the engagement of the pawl with the ratchet wheel, thereby adjusting the linespacing apparatus for the number of linespaces desired.

BRIEF DESCRIPTION OF THE DRAWINGS

Additional objects and advantages of the present invention will become apparent during the course of the following specification when taken in connection with the accompanying drawings in which.

DETAILED DESCRIPTION OF THE INVENTION

Figure 1:
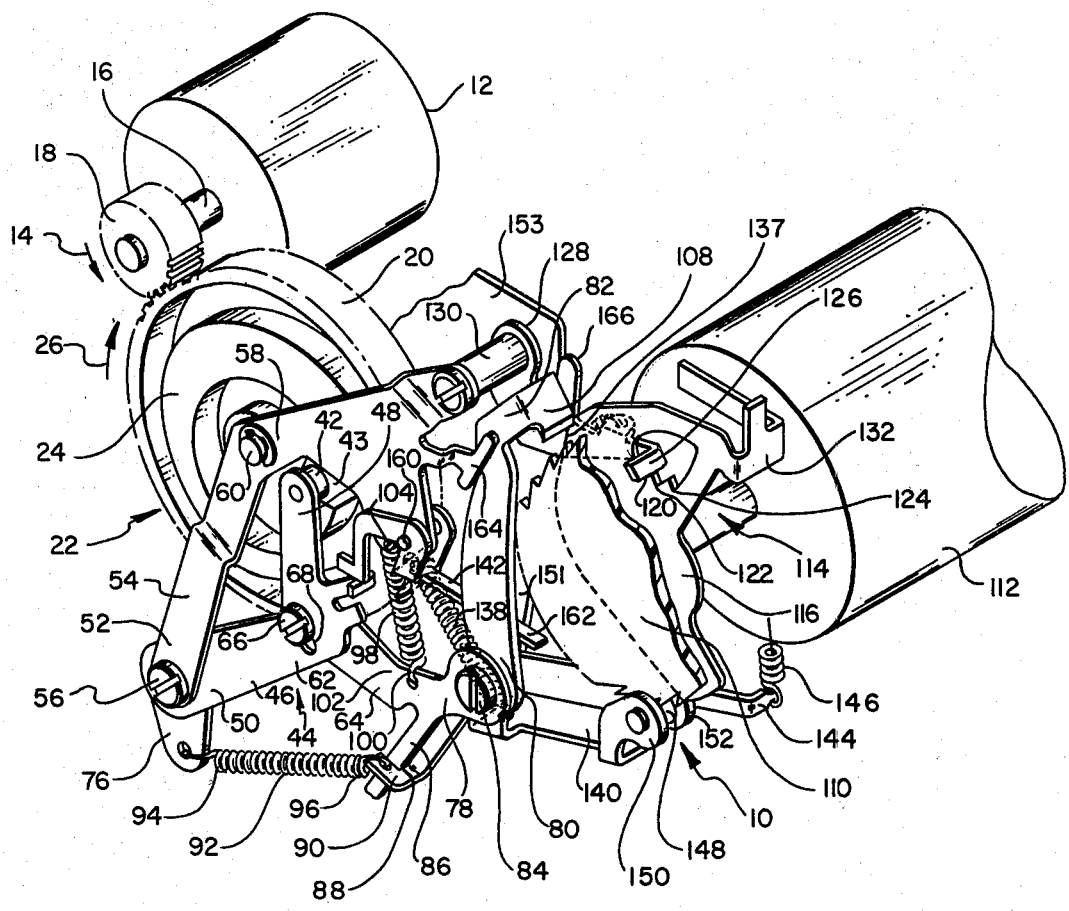
FIG. 1 is an overall perspective view of a motor driven linespacing apparatus made in accordance with the present invention.

With reference to the drawings, there is shown in FIG. 1 a linespacing apparatus in accordance with the present invention, which is powered by an electric motor 12. The electric motor 12 is preferably a D.C. motor and is connected to a conventional control circuit, which is not shown. The electric motor 12 is activated by depressing selected keys on the keyboard of a typewriter, which is also not shown.

Figure 2:
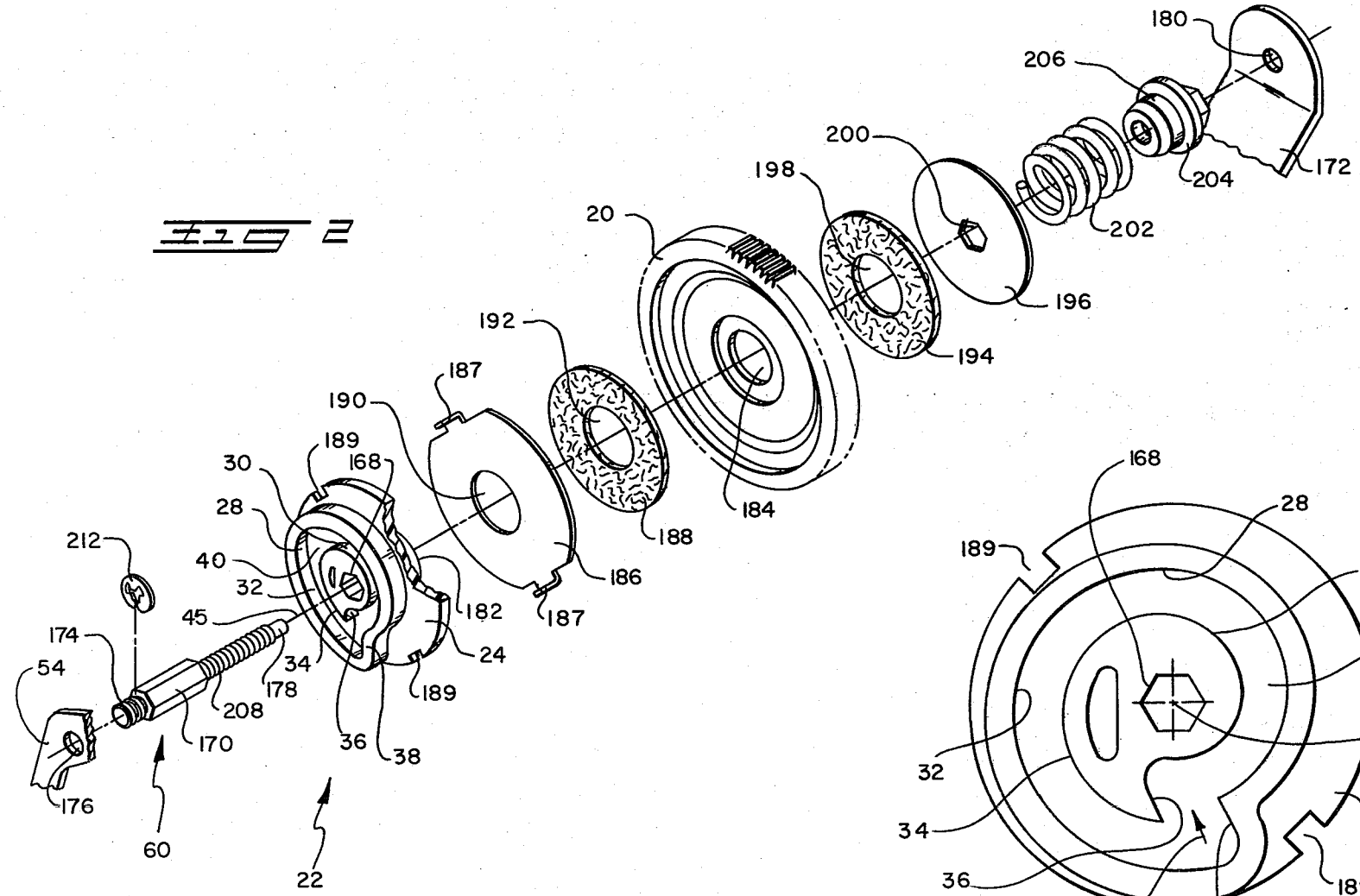
FIG. 2 is an exploded view of a friction clutch which forms part of the motor driven linespacing apparatus of FIG. 1.

Upon receipt of a pulse signal from the control circuit, the electric motor 12 rotates in a counter clockwise direction, as indicated by the arrow 14 in FIG. 1. The electric motor 12 includes a drive shaft 16 on which there is mounted a gear 18. The gear 18 is in mesh with a larger gear 20. The electric motor 12 is adjustably mounted on a conventional mounting plate, which is not shown and which is adjustable in order to control the drive mesh between the gears 18 and 20. The gear 20 is part of a friction clutch assembly 22 which is best shown in FIG. 2 and which will be presently described in detail.

Figure 4:
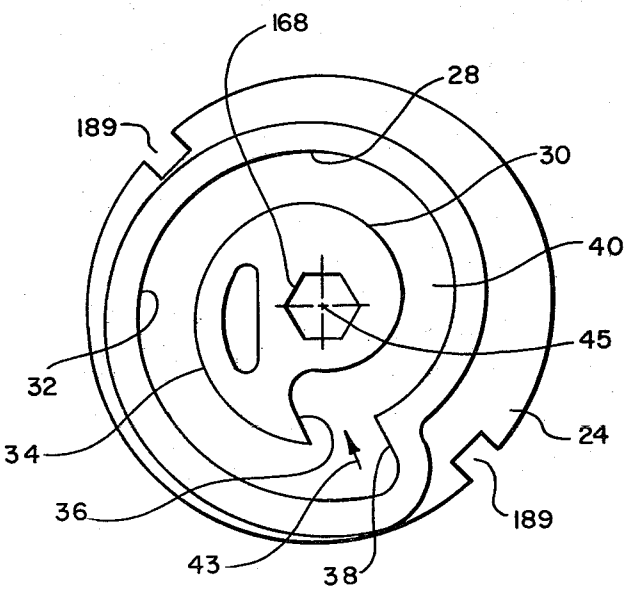
FIG. 4 is a side elevation view of the face cam.

A face cam 24 is a part of the friction clutch assembly 22 and is frictionally coupled by the friction clutch assembly 22 to the gear 20 so that when the gear 20 is rotated in a clockwise direction, as indicated by the arrow 26 in FIG. 1 by the gear 18, the face cam 24 is also rotated. The face cam 24 which is best shown in FIG. 4, comprises a pair of profile surfaces 28, 30 which include a pair of curved wall portions 32, 34 and a pair of straight wall portions 36, 38 which are generally radially disposed. The profile surfaces 28, 30 define a recessed portion or groove 40 which constrains the motion of a follower roller 42. The straight wall portion 36 forms an initial position for the follower roller 42. The rotational motion of the face cam 24 in the direction of the arrow 26 is limited by the follower roller 42 abutting the wall 38, abruptly stopping the face cam 24. The straight wall portions 36, 38 form a passageway 43 substantially radial relative to the axis 45 of the face cam 24. The follower roller 42 passes through the passageway 43 when returning from the abutment wall portion 38 to the initial wall portion 36.

The follower roller 42 is a part of the linespace bellcrank assembly 44 which includes a cam follower arm 46. The follower roller 42 is rotationally mounted on the end 48 of the cam follower arm 46. The end 50 of the cam follower arm 46 is connected to the end 52 of the bracket 54 by means of the screw 56. The central portion 58 of the bracket 54 supports the shaft 60 which is part of the friction clutch assembly 22. The central portion 62 of the cam follower arm 46 is connected to the arm 64 by means of the screw 66, which passes through the slot 68 formed in the cam follower arm 46. The arm 64 has a portion 70 which is disposed behind a portion 72 of the cam follower arm 46 and which is indicated in broken lines in FIG. 3. The portion 70 of the arm 64 has an end 74 which is pivotally connected to the bracket 54 and the cam follower arm 46 by the screw 56. The arm 64 also includes a portion 78 which is pivotally connected to an intermediate portion 80 of a linespace pawl 82 by means of a pivot 84 and a downwardly projecting member 86 which abuts the lower end 88 of the linespace pawl 82 thereby acting as a stop. The lower end 88 of the linespace pawl 82 includes a tab 90. A helical tension spring 92 has ends 94, 96 which are connected to the tabs 76 and 90, respectively, and the helical tension spring 92 urges the lower end 88 of the linespace pawl 82 to abut the downwardly projecting member 86 as is shown in FIG. 1.

Figure 3:
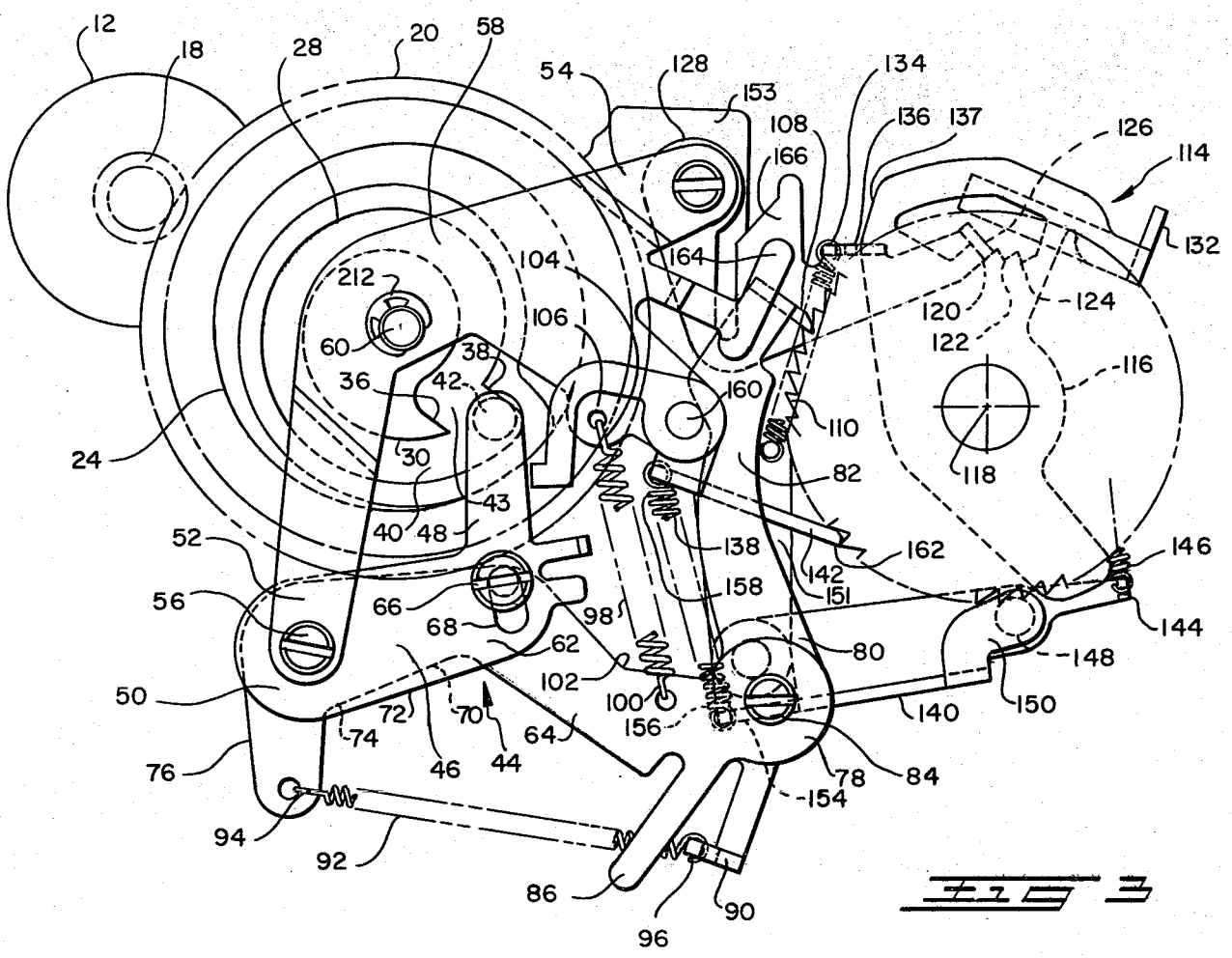
FIG. 3 is a side elevation view of the motor driven linespacing apparatus of FIG. 1.

A helical tension spring 98 is provided, which has a lower end 100 which is connected to a portion 102 of the arm 64 and an upper end 104 which is connected to the tab 106 on the bracket 54 as is best shown in FIG. 3. The helical tension spring 98 urges the arm 64 upward, thereby ensuring contact between the follower roller 42 and the profile surface 30 of the face cam 24. As the face cam 24 is rotated, the arm 64 is driven downward pivoting clockwise about the screw 56 and pulling the lip 108 of the linespace pawl 82 into engagement with the ratchet wheel 110 and thereby indexing the ratchet wheel 110.

The ratchet wheel 110 is connected to the platen 112 through a platen variable assembly 114 which is adjustable to provide various platen indexing such as 1, 1½ or 2 space line feeds. The platen variable assembly 114 includes a line selector member 116 which pivots about the platen axis 118 and which includes detents 120, 122, 124 which cooperate with a selector pawl member 126, the end 128 of which is connected via a pivot post 130 to the upper portion of the bracket 54. The position of the selector pawl member 126 may be adjusted by an operator using an arm 132 which projects from the line selector member 116 so that either detent 120, 122 or 124 is in engagement with the selector pawl member 126. The selector pawl member 126 is urged in a downward direction by the helical tension spring 134 shown in FIG. 3, which is connected to the tab 136 on the selector pawl member 126. The helical tension spring 134 acts to maintain the setting of the selector pawl member 126. The engagement of the selector pawl member 126 in one of the detents 120, 122, 124 controls the engagement of the linespace pawl 82 with the ratchet wheel 110 by the lip 108 riding off from a cam surface 137 formed on the arm 132 and thereby controls the platen feed. For example, the engagement of the selector pawl member 126 in the detent 120 as is shown in FIG. 3 results in the minimum drive of the ratchet wheel 110 resulting in a platen feed of one space. Engagement of the selector pawl member 126 in the detent 124 would result in the maximum drive of the ratchet wheel 110 which would result in a platen feed of two spaces. The maximum drive of the ratchet wheel 110 is provided by the profile surface 30 of the face cam 24.

The specification of platen feeds of 1, 1½ and 2 spaces has been made by way of example only and the linespacing apparatus according to the present invention may be configured to provide other desired values of linespacing.

Upon completion of the linespacing function, the helical tension spring 98 restores the linespace bellcrank assembly 44 to its original position as shown in FIG. 1. The position of the ratchet wheel 110 is held by the detent arm 140 and the pawl member 142. The detent arm 140 has an end 144 which is urged in upward direction by the helical tension spring 146 and a roller 148 which is mounted on an integrally formed pair of brackets 150, 152 and which engages the ratchet wheel 110 as is best shown in FIG. 3. The detent arm 140 is pivotally mounted on an arm 151 formed from a carriage end frame 153 and the end 154 of the detent arm 140 is connected to the lower end 156 of the helical tension spring 138. The upper end 158 of the helical tension spring 138 is connected to the pawl member 142 which is pivotally mounted on the bracket 54 by means of the pivot 160. The end 162 of the pawl member 142 engages the ratchet wheel 110 as is best shown in FIG. 3 thereby maintaining the position of the ratchet wheel 110 in combination with the detent arm 140.

The lateral motion of the linespace pawl member 82 is guided by a guide member 164 formed on the bracket 54 and by a guide member 166 formed on the selector pawl 126.

The friction clutch assembly 22 is best shown in FIG. 2 and includes the face cam 24 and the gear 20 which have been described previously. The face cam 24 includes a hexagon hole 168 which fits on the hexagon portion 170 of the shaft 60. The shaft 60 is rotably mounted between the bracket 54 and the plate 172 formed from the carriage end frame 153 with the circular portion 174 of the shaft 60 passing through the hole 176 in the bracket 54 and the circular portion 178 passing through the hole 180 in the plate 172. The face cam 24 is keyed to the hexagon portion 170 of the shaft 60 while the gear 20 is rotatably mounted on the shoulder 182 of the face cam 24 with the shoulder 182 of the face cam 24 projecting through the hole 184 on the gear 20. Between the face cam 24 and the gear 20 there is a metal plate 186 and a felt pad 188 both of which have large central holes 190, 192 which fit over the shoulder 182 on the face cam 24. The plate 186 has two tabs 187 which seat in notches 189 in the face cam 24, thereby keying the metal plate 186 to the face cam 24 for rotation with the face cam 24. On the other side of the gear 20 there is another felt pad 194 and a metal plate 196. The felt pad 194 has a center hole 198 and the plate 196 has a hexagon hole 200 which fit onto the portion 170 of the shaft 60 thereby keying the metal plate 196 to the shaft 60. A compression spring 202 bears against the metal plate 196. An adjustable compression nut 204 which includes a shoulder portion 206 is mounted on the threaded portion 208 of the shaft 60. The nut 204 controls the amount of force which is applied to the gear 20, which is thus frictionally coupled to the face cam 24 through the felt pads 188, 194 and the metal plates 186, 196. The nut 204 is tightly threaded onto portion 208 to maintain its adjusted position. A retainer ring 212 prevents the shaft 60 from slipping off the bracket 54.

The amount of friction force produced by the spring 202 is adjusted so the face cam 24 is driven by the friction clutch assembly 22 during the linespacing operation. When the face cam 24 is abruptly halted by the action of the follower roller 42 abutting the wall 38 of the face cam 24, slippage occurs producing relative motion between the gear 20 and the face cam 24. The effect of this slippage is to eliminate bounce between the wall 38 and the roller 42 and to allow the gear 20 to continue to rotate as the motor 12 comes to a stop. The friction clutch assembly 22 thus compensates for the effects of the inertia of the D.C. motor 12 and the various elements and prevents torsional stress between the gears 18, 20. The elimination of bounce and recoil between the roller 42 and the face cam 24 by the friction clutch assembly 22 ensures smooth operation of the linespace apparatus 10.

While a preferred emnbodiment of the invention has been shown and described herein, it is obvious that numerous additions, changes and omissions may be made in such embodiment without departing from the spirit and scope of the invention.

What is claimed is:

1. A linespacing apparatus for linespacing a platen including an electric motor, slip clutch means, driving connection means connecting the electric motor and the slip clutch means, cam means, linkage means including a cam follower driven by the cam means, and ratchet means mounted on the platen engaged and rotated by the linkage means for rotating the platen a selected amount in response to rotation of the electric motor, the cam means comprising:

a face cam having a first profile surface to engage and drive the cam follower;

said face cam having a second profile surface which includes an abutment wall portion engaged by the cam follower to limit rotating motion of said face cam for limiting the drive of the linkage means; and said first profile surface includes a straight wall portion forming an initial position for the cam follower, said straight wall portion and said abutment wall portion form a passageway for the cam follower to move from said abutment wall portion to said straight wall portion.

2. A linespacing apparatus according to claim 1 in which said face cam has an axis of rotation and in which said passageway is substantially radially disposed relative to said axis.

3. A linespacing apparatus according to claim 1 in which the slip clutch means comprises shaft means keyed to the cam means, a first friction pad keyed to the cam means with said first friction pad abutting a face of the cam means, a spur gear rotatably mounted on said shaft means and disposed to be driven by said electric motor, with the spur gear including a first face abutting said first friction pad, a second friction pad keyed to said shaft means and with said spur gear including a second face abutting said second friction pad, and compression means mounted on said shaft means and disposed to urge said first and said second friction pads against said first and said second faces of said spur gear, thereby forming a driving connection between said spur gear and the cam means, which is operative until the driving connection is overcome by forces on the cam means enabling the cam means to slip relative to said spur gear.

4. A linespacing apparatus according to claim 3 in which the cam means includes a shoulder portion and in which said spur gear is rotationally mounted on said shoulder.

5. A linespacing apparatus according to claim 3 in which said compression means comprises a compression spring mounted on said shaft means.

6. A linespacing apparatus according to claim 3 in which said first and said second friction pads each comprise a felt pad disposed adjacent said spur gear and a metal plate disposed adjacent said felt pad.

* * * * *